US007938294B2

(12) United States Patent
Cittadino et al.

(10) Patent No.: US 7,938,294 B2
(45) Date of Patent: May 10, 2011

(54) HIGH CAPACITY NAPKIN DISPENSER

(75) Inventors: Antonio M. Cittadino, Appleton, WI (US); David R. Maroney, Cedar, MN (US); Brent J. Burns, Sterling Heights, MI (US); Karl D. Kissinger, Appleton, WI (US); Andy L. Kirkpatrick, Green Bay, WI (US); Michael R. Kilgore, Little Suamico, WI (US); Gregory D. Budz, Sobieski, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 12/506,334

(22) Filed: Jul. 21, 2009

(65) Prior Publication Data

US 2009/0277920 A1 Nov. 12, 2009

Related U.S. Application Data

(62) Division of application No. 11/126,006, filed on May 10, 2005, now Pat. No. 7,568,593.

(60) Provisional application No. 60/627,866, filed on Nov. 15, 2004.

(51) Int. Cl.
*B65H 1/00* (2006.01)

(52) U.S. Cl. ..... 221/62; 221/45; 221/55; 221/56; 221/61

(58) Field of Classification Search ..... 221/45, 221/55, 56, 61, 62
See application file for complete search history.

(56) References Cited

U.S. PATENT DOCUMENTS

| | | | | |
|---|---|---|---|---|
| 2,840,268 A | | 6/1958 | Casey et al. | |
| 3,777,931 A | * | 12/1973 | Fleming | 221/57 |
| 4,094,442 A | | 6/1978 | Radek | |
| 4,155,484 A | | 5/1979 | Pastore | |
| 4,311,252 A | * | 1/1982 | Hope et al. | 221/57 |
| 4,329,001 A | | 5/1982 | Filipowicz et al. | |

(Continued)

FOREIGN PATENT DOCUMENTS

EP 0101287 A2 2/1984

(Continued)

OTHER PUBLICATIONS

European Search Report issued Oct. 5, 2006.

*Primary Examiner* — Timothy R Waggoner
(74) *Attorney, Agent, or Firm* — William W. Letson

(57) ABSTRACT

A large capacity napkin dispenser for in counter mounting includes: (a) an elongate housing having a generally rectangular cross-section for receiving a stack of napkins; (b) a faceplate with a dispensing aperture, the faceplate being hinged to the housing so as to be movable between an open position for re-loading and a closed position for dispensing; (c) a movable support member mounted in the housing; (d) biasing means for urging the movable support toward the faceplate so that the stack of napkins is advanced to the aperture as it is depleted; and (e) sequestered means for locking the faceplate in the closed position. The locking means includes release means located adjacent the inner surface of the faceplate such that when the faceplate is in the closed position the release means is concealed in the interior of the dispenser, thereby eliminating the need for a key. The dispenser further includes internal gripping surfaces which facilitate re-loading and smooth operation as well as molded-in features which greatly reduce cost of manufacture.

5 Claims, 7 Drawing Sheets

U.S. PATENT DOCUMENTS

| | | | | |
|---|---|---|---|---|
| 4,343,415 | A | 8/1982 | Radek | |
| 4,706,844 | A | 11/1987 | Omdoll et al. | |
| 5,131,561 | A | 7/1992 | Casperson et al. | |
| 5,156,293 | A | 10/1992 | Petterson et al. | |
| 5,632,409 | A | 5/1997 | Raghunanan | |
| 5,964,375 | A | 10/1999 | Carlson et al. | |
| 6,003,724 | A * | 12/1999 | Collins et al. | 221/154 |
| 6,241,118 | B1 | 6/2001 | Tramontina | |
| 6,257,443 | B1 | 7/2001 | LaCount et al. | |
| 6,773,653 | B2 | 8/2004 | Miller et al. | |
| 6,899,251 | B2 | 5/2005 | Christensen et al. | |
| 6,929,147 | B2 | 8/2005 | Guillemette et al. | |
| 7,093,737 | B2 * | 8/2006 | Tramontina et al. | 221/46 |
| 7,124,911 | B2 | 10/2006 | Tramontina et al. | |

FOREIGN PATENT DOCUMENTS

| | | | |
|---|---|---|---|
| EP | 1279361 | A1 | 1/2003 |
| GB | 1564451 | A1 | 4/1980 |
| WO | 98/22009 | A1 | 5/1998 |
| WO | 2004093629 | A1 | 11/2004 |

* cited by examiner

HIGH CAPACITY NAPKIN DISPENSER

CROSS-REFERENCE TO RELATED APPLICATIONS

This application is a division of U.S. application Ser. No. 11/126,006, filed May 10, 2005, which claims the benefit of U.S. Provisional Application Ser. No. 60/627,866, filed Nov. 15, 2004, both of which are incorporated by reference in their entirety.

TECHNICAL FIELD

The present invention relates generally to napkin dispensers and in a preferred embodiment to an in-counter, high capacity napkin dispenser with an injection-molded faceplate having a concealed latch accessible through its dispensing aperture.

BACKGROUND

Napkin dispensers are well known in the art. There is disclosed in U.S. Pat. No. 4,311,252 to Hope, Jr. et al., a large capacity elevator-type napkin dispenser comprising an elongated supporting structure or cage composed of a series of spaced rod-like vertical supports. A stack of folded napkins is supported on a pressure plate that is mounted on a carriage adapted to slide vertically within the cage. The pressure plate is supported from the carriage by a plurality of compression springs which enable the pressure plate to float and accommodate the varying thickness of the stack of folded napkins. A cover is mounted on the upper end of the cage and has an opening through which the napkins are dispensed. The pressure plate and stack of napkins are urged upwardly toward the undersurface of the cover by a biasing mechanism that includes a pair of extension springs. The springs have a varying spring rate so that the force of the springs will be greatest when the pressure plate is fully loaded with napkins.

Radek discloses another vertically oriented napkin dispenser in U.S. Pat. No. 4,094,442 wherein there is shown a napkin dispenser for disposition on a restaurant table or counter and normally housing a stack of paper napkins. The dispenser is in the form of a parallelpiped with a top access opening for loading and removing napkins. The opening is generally rectangular except for a concavely arcuate edge on one side from which napkins are normally extracted. Two opposed sides of the opening normal to the arcuate edge are provided with a pair of relatively narrow spring biased leaves resiliently extendable into the container to facilitate loading, the free edges of said leaves being longitudinally gently oblique and widening toward the aforesaid arcuate edge. Each of said leaves has a longitudinal outwardly turned lip and the exposed corners of the leaves are rounded. All of said features contribute toward convenient extraction of a napkin without damage. See also, U.S. Pat. No. 4,343,415, also to Radek.

Further features of napkin and towel dispensers are seen in the following: EPO Application 0 101 287 of Evans; U.S. Pat. No. 4,329,001 of Filipowicz et al. U.S. Pat. No. 2,840,268 of Casey et al.; U.S. Pat. No. 4,155,484 of Pastore; U.S. Pat. No. 5,156,293 of Pelterson et al.; and U.S. Pat. No. 5,964,375 of Carlson et al.

Despite advances in the art, many issues with dispensers remain unresolved. For one, most napkin dispensers do not have a large capacity and need to be re-filled frequently adding to labor costs and/or causing consumer inconvenience. Moreover, it is desirable to lock dispensers so that they cannot be opened by unauthorized personnel; however, keys get lost. It will be appreciated from the foregoing patents that existing dispensers are relatively expensive to fabricate and install especially when made of multiple parts including metal parts requiring multiple fasteners, springs, brackets and the like.

Existing high capacity napkin dispenser are also oftentimes difficult to reload. When the cover is open, the napkins are not sufficiently retained within the dispenser such that a technician must exercise considerable skill in order to refill the dispenser without assistance or damaging product.

Still yet other issues include reliably feeding the napkins to the dispensing aperture without damaging the product by way of tearing, or jamming of the dispenser as will be appreciated by one of skill in the art.

SUMMARY OF THE INVENTION

The present invention provides an improved high capacity napkin dispenser with multiple features which provide for superior operation. The inventive features include a sequestered locking mechanism which is easy to operate and which is hidden within the dispenser such that a technician with knowledge of its operation can readily unlock the dispenser without the need for a key. Another aspect of the invention includes gripping surfaces adjacent the faceplate so that a stack of napkins can be retained within the dispenser while the face plate is open, yet the gripping surfaces will not interfere with feeding product to the aperture when the faceplate is closed. Preferably, the gripping surfaces are bowed surfaces which facilitate feeding product to the aperture of the dispenser as illustrated in the appended drawings and described herein.

Still yet another aspect of the present invention is an injection molded construction which dramatically reduces the cost of high capacity dispensers, providing an order of magnitude reduction in cost. A high capacity dispenser of the invention may be produced for as little as 15-30 dollars as opposed to 150-250 dollars and more for conventional products of similar capacity. Such dramatic cost reductions are achieved by providing identical panels for defining the storage chamber, as well as, for example, identical plates for holding a biasing spring, as well as, for example, utilizing molded-in label technology to provide for a suitable appearance. Injection-molded parts and panels with molded-in assembly features make it possible to greatly reduce assembly complexity. Still yet other features and advantages of the present invention will become apparent from the discussion which follows.

There is provided in a first aspect of the invention a large capacity napkin dispenser comprising: (a) an elongate housing defining a storage chamber with a generally rectangular cross-section for receiving a stack of napkins; (b) a faceplate with a dispensing aperture extending between a first and a second side of the dispenser, the faceplate being hinged to the housing at the first side so as to be movable between an open position for re-loading and a closed position for dispensing, the faceplate having an outer surface and an inner surface which is inside the dispenser when the faceplate is in the closed position; (c) a movable support member mounted in the housing; (d) biasing means for urging the movable support toward the faceplate so that the stack of napkins is advanced to the aperture as it is depleted; and (e) means for locking the faceplate in the closed position, the locking means being operable to lock the faceplate to the second side of the dispenser in the closed position and includes release means located adjacent the inner surface of the faceplate such that when the faceplate is in the closed position the release means is concealed in the interior of the dispenser and accessible through the dispensing aperture. In a preferred embodiment the faceplate is hinged to a mounting bracket secured to the housing and the release means of the locking means is located adjacent one end of the dispensing aperture. Especially preferred are constructions wherein the locking means includes an injection-molded unitary latch including both an integrally formed spring and a latch member. The injection-molded unitary latch is formed from an injection-molding composition comprising nylon, polyacetal or polyester.

The faceplate preferably has a plurality of guide ridges at its inner surface and the injection molded unitary latch has a pair of spring arms configured to engage a guide ridge. The unitary latch is provided with a beveled edge in preferred constructions to facilitate operation of the dispenser, while the faceplate is perhaps most preferably integrally formed by injection-molding and includes a plurality of guide ridges at its inner surface. The guide ridges comprise triangular guide ridges having a profile inclined toward the dispensing aperture so as to guide the napkin stack thereto. In a preferred embodiment the guide ridges extend progressively further from the inner surface of the faceplate with increasing distance from the aperture thereby flaring away from the aperture. The guide ridges may be further characterized in that: (i) the guide ridges are generally orthogonal to an elongate axis of the dispensing aperture; and (ii) the guide ridges are generally parallel to an axis of the storage chamber when the faceplate the closed position. Suitable materials for the faceplate include an injection-molding composition comprising an acrylonitrile-butadiene-stylene resin or injection-molding compositions comprising an acrylic resin or a polycarbonate resin.

The housing is also preferably made by way of injection-molding, including injection-molding at least two panels having molded-in features for joining the panels to each other. These panels are made from an injection-molding composition comprising an acrylonitrile-butadiene-styrene resin or these panels are made from an injection-molding composition comprising an acrylic resin or a polycarbonate resin. A particularly cost effective method of manufacturing the dispenser is wherein the generally rectangular storage chamber has sidewalls defined by two substantially identical U-shaped channel members molded from a polymer composition as noted above. The housing is vertically oriented when the dispenser is an in-counter dispenser and is sized to accommodate at least about 1,000 single-fold napkins.

Another feature of the present invention which makes the dispenser particularly cost effective includes a construction wherein a helical spring is secured to two substantially identical plates which are molded from a polymer composition in order to provide biasing means to advance the napkins to the dispensing aperture. Preferably, the substantially identical plates include molded-in locking means for securing the helical spring. A particularly preferred construction is wherein the helical spring has at its extremities two end portions which project radially inwardly with respect to the axis of the spring and the plates each include molded-in quick lock features for securing the spring thereto without other hardware. This feature eliminates the need for additional screws, brackets and so forth as well as greatly reduce fabrication labor required to produce the dispenser. The quick lock feature is perhaps most preferably achieved by including a radial hook with a radial locking finger extending radially outwardly with respect to the axis of the helical spring and a tangential hook with a locking finger extending tangentially with respect to the coils of the helical spring. The tangential hooks have locking protuberances on surfaces thereof opposed to their respective plates in order to secure the spring and to hinder rotation of the spring with respect to the plates to which the spring is secured. Optionally included are a plurality of positioning posts for positioning the spring with respect to the plates in addition to the hooks. The plates are thus adapted to operate as the movable support member to advance the napkins to the dispensing aperture.

The construction is achieved with a minimum of molds. As one of skill in the art will appreciate, molds for injection-molding are quite expensive and can add many tens of thousands of dollars to the capital cost involved for each part.

In another aspect of the invention, there is provided a large capacity napkin dispenser including: (a) an elongate housing defining a storage chamber with a generally rectangular cross-section for receiving a stack of napkins; (b) a faceplate with a dispensing aperture extending between a first and a second side of the dispenser, the faceplate being hinged to the housing at the first side so as to be movable between an open position for re-loading and a closed position for dispensing, the faceplate further having an outer surface and an inner surface which is inside the dispenser when the faceplate is in the closed position; (c) a movable support member mounted in the housing; (d) biasing means for urging the movable support toward the faceplate so that the stack of napkins is advanced to the aperture as it is depleted; (e) means for locking the faceplate in the closed position; and (i) means for gripping the napkin stack adjacent the faceplate to control advancement of the napkin stack to the aperture. Preferably, the means for gripping the stack include a pair of opposed gripping surfaces which define a progressively decreasing span in the direction of the dispensing aperture such as wherein the gripping surfaces each have an inwardly convex bowed profile and define a progressively decreasing span. In a preferred embodiment, the means for gripping the napkin stack adjacent the faceplate are effective to retain the napkin stack within the elongate housing when the faceplate is in the open position.

Another aspect of the invention is a kit for converting existing dispensers. There is thus provided a kit with a locking faceplate for mounting on a napkin dispenser housing comprising: (a) a mounting bracket; (b) means for securing the mounting bracket to the dispenser housing; (c) a faceplate with an elongate aperture; (d) hinge means for pivotally mounting the faceplate to the mounting bracket such that it is movable between a closed position for dispensing a stack of napkins and an open position for reloading; and (e) means for locking the faceplate in the closed position, the locking means being operable to lock the faceplate to the mounting bracket in the closed position and including release means for unlocking the faceplate located adjacent an inner surface of the faceplate such that when the faceplate is in the closed position on a dispenser the release means is concealed in the interior of the dispenser and accessible through the dispensing aperture. The means for securing the mounting bracket to the dispenser includes a mounting collar adapted to be secured to the mounting bracket; ordinarily about a flange in the housing of an existing dispenser. Here again the locking means includes biasing means adapted to maintain it in a locking position and the locking means preferably includes an injection-molded unitary latch including an integrally-formed spring and a latch member as noted above.

Another aspect of the invention provides an injection-molded unitary faceplate for a napkin dispenser made from an injection-molding composition, the faceplate having a dispensing aperture as well as a plurality of guide ridges on an inner surface thereof inclined toward the aperture, the faceplate being further provided with a molded-in label film on an outer surface thereof; the label film including an outwardly facing polymer film layer extending over substantially the entire outer surface of the faceplate. Typically, the molded-in label film comprises a polymer film layer and an ink layer. The ink layer may be formulated to mimic a metallic finish. In a preferred embodiment, the label film consists of a thermoplastic polymer film layer and an ink layer, wherein the ink layer is melt-bonded to the injection-molding composition and the outwardly facing polymer film layer is a polycarbonate film. In many cases, a heat activated adhesive will be used between the ink layer and the underlying polymer. However, if the proper outer thermoplastic polymer film layer is chosen for compatibility with the ink and the underlying polymer, it may be possible to dispense with the heat activated adhesive layer entirely.

A method of making an injection-molded faceplate for a napkin dispenser of the invention includes: (a) printing an ink composition onto a thermoplastic polymer film; (b) thermoforming the film into a shape suitable for a faceplate layer; and (c) injection-molding structural resins onto the ink layer of the thermoformed film, wherein the faceplate is provided with a dispensing aperture and the polymer film extends over substantially the entire outer surface of the faceplate.

The present invention is also directed to using the improvements noted above to dispense napkins.

Still further features and advantages of the present invention will become apparent from the discussion which follows.

BRIEF DESCRIPTION OF THE DRAWINGS

The invention is described in detail below with reference to the various drawings wherein like numbers designate similar parts in the drawings.

DETAILED DESCRIPTION OF THE INVENTION

Figure 1:
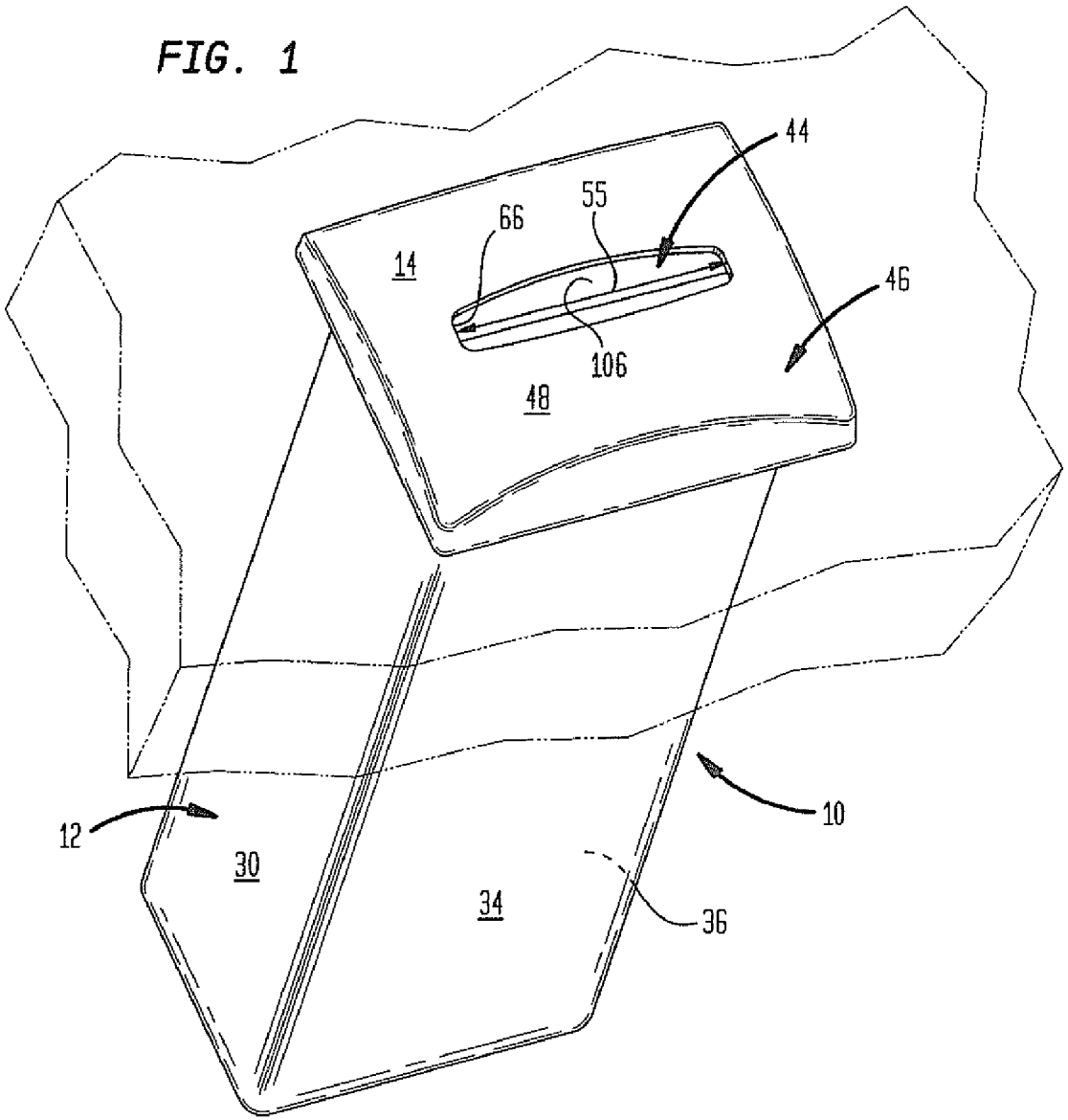
FIG. 1 is a perspective view of the dispenser of the invention mounted in-counter.
Figure 2:
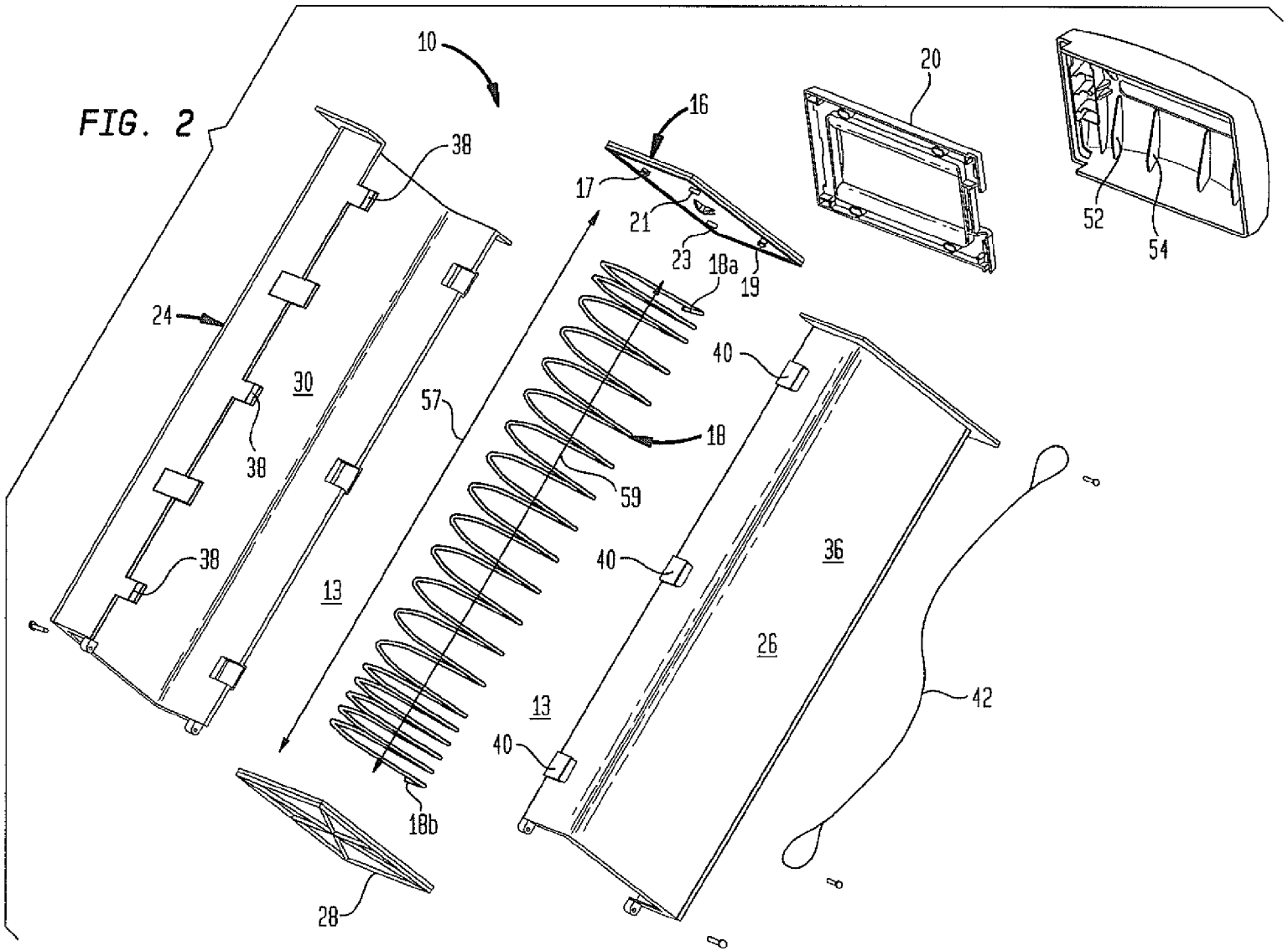
FIG. 2 is an exploded perspective view of the napkin dispenser of FIG. 1, showing its various components.

The invention is described in detail below with reference to the drawings for purposes of illustration only. Modifications within the spirit and scope of the invention, set forth in the appended claims will be readily apparent to one of skill in the art.

Referring to FIGS. 1 through 10, there is shown a high capacity napkin dispenser 10 including a housing 12, a faceplate 14 and a movable support plate 16 provided with a biasing spring 18. Faceplate 14 is hinged to a mounting bracket 20 which, in turn, is secured to housing 12. A hinge suitably includes a pin (not shown) as well as a hinge plate 22 to secure faceplate 14 to bracket 20 such that it pivots between a closed position (FIG. 1) and an open position for reloading. Hinge plate 22 optionally includes ribs 23.

Housing 12 and faceplate 14 thus define a storage chamber generally indicated at 13 for receiving a stack of napkins.

Housing 12 suitably includes two multi-faceted panels 24, 26 as well as an end plate 28. Panels 24, 26 define opposed sidewalls 30, 32, 34 and 36 when secured together by way of tabs 38 which fits in slots 40. Preferably, plates 16, 28 are injection-molded and of identical construction. This reduces fabrication costs as well as provides an opportunity to include molded-in features in the plate such as the quick lock mounting for spring 18 described herein, So also, panels 24, 26 are of identical construction which saves considerable capital costs when producing the molds. Injection-molding allows for providing multiple molded-in features which reduces the number of parts as well as the labor required to fabricate the inventive dispensers.

Figure 8:
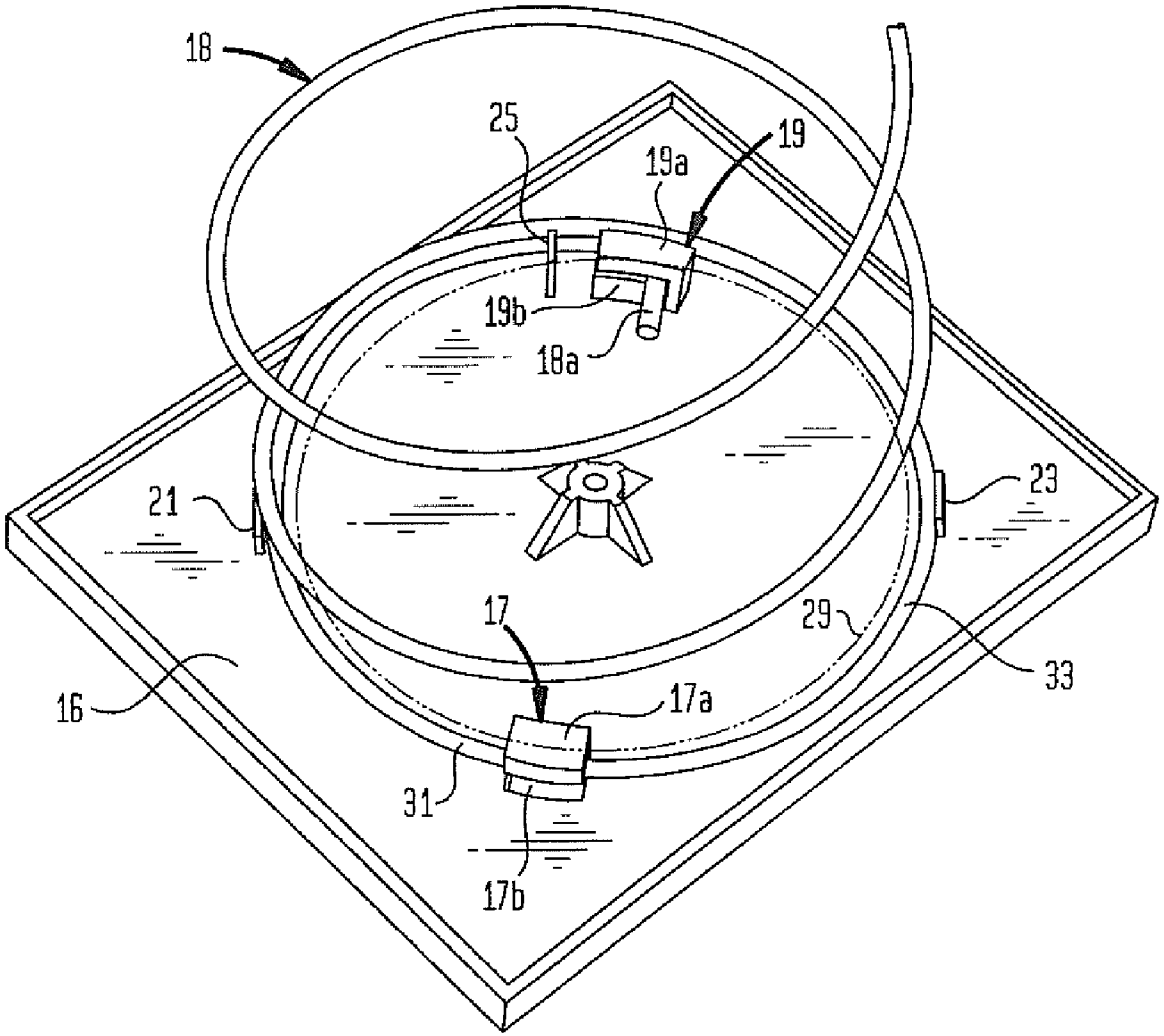
FIG. 8 is an enlarged detail showing support plate 16 of FIG. 2 with spring 18 attached thereto.
Figure 9:
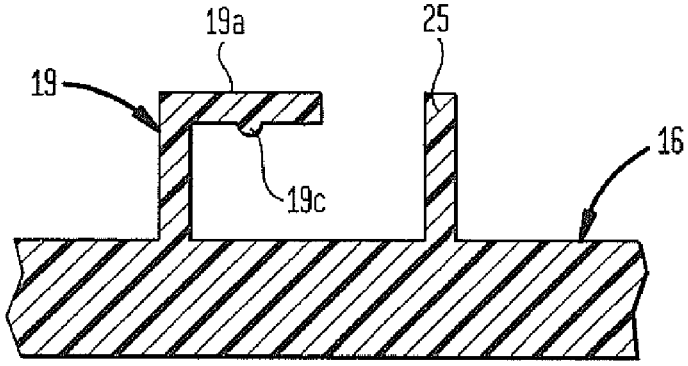
FIG. 9 is a detail showing a portion of support plate 16.

An optional tether 42 secures plate 28 to movable support plate 16 so that when the empty dispenser is opened support plate 16 is not pushed out of the interior of the housing by spring 18. Preferably, the ends of the spring are bent inwardly at ends 18*a*, 18*b* and secured to support plates 16, 28 provided by way of quick locking hooks 17, 19 with fingers 17*a* and 19*a* over apertures 17*b* and 19*b* respectively configured so that a tether is not necessary. Details are best seen in FIGS. 8, 9. In particular, retention finger 17*a* projects radially outward while retention finger 19*a* projects tangentially with respect to the coils of helical spring 18. Retention protuberance 19*c* formed on the lower surface of retention finger 19*a* serves to retain the inwardly projecting free end 18*a* of helical spring 18. Guide posts 21 and 23 together with rack 17 and 19 as well as stop pin 25 define an imaginary mounting circle 29. During assembly, inwardly projecting end 18*a* of helical spring 18 may be placed between stop pin 25 and retention hook 19 while diametrically opposed portion 31 of helical spring 18 is slipped under retention finger 17*b* with guide posts 21 and 23 restraining lowermost coil 33 of helical spring 18. Helical spring 18 is then locked into position by urging inwardly projecting end 18*a* of helical spring 18 under retention finger 19*a* and past a retention protuberance protuberance 19*c* thereby locking helical spring 18 in place. This arrangement (repeated with plate 28 on the other end of spring 18) greatly expedites assembly of the dispenser. Further, plates 16 and 28 may be substantially identical eliminating extra cost for an additional mold.

After assembly and loading with napkins, the weight of a napkin stack compresses spring 18 which, in turn, forces the stack to the faceplate as the stack is depleted.

Faceplate 14 is provided with an elongate aperture 44 which extends between sidewalls 30 and 36 and provides access to the napkin stack. At the outer surface 46 of the faceplate there is optionally provided a molded-in label film layer 48, which extends substantially over the entire outer surface of faceplate 14. At the inner surface 50 of faceplate 14 there is provided a plurality of triangular guide ridges 52, 54 and so forth inclined towards aperture 44 as is seen in FIG. 3.

Figure 3:
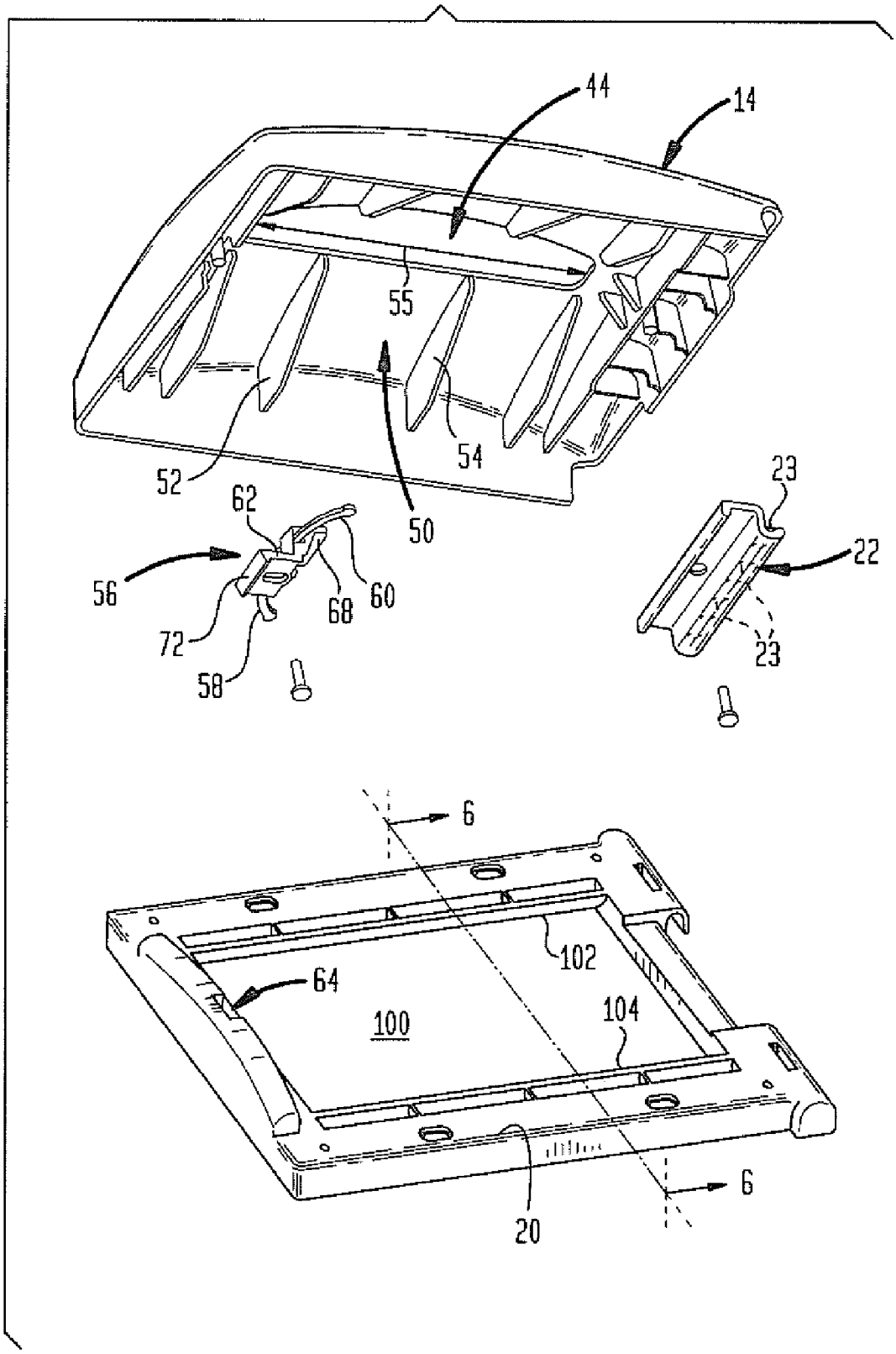
FIG. 3 is a perspective view of the faceplate of FIGS. 1 and 2 and the mounting bracket of FIGS. 1 and 2.
Figure 4:
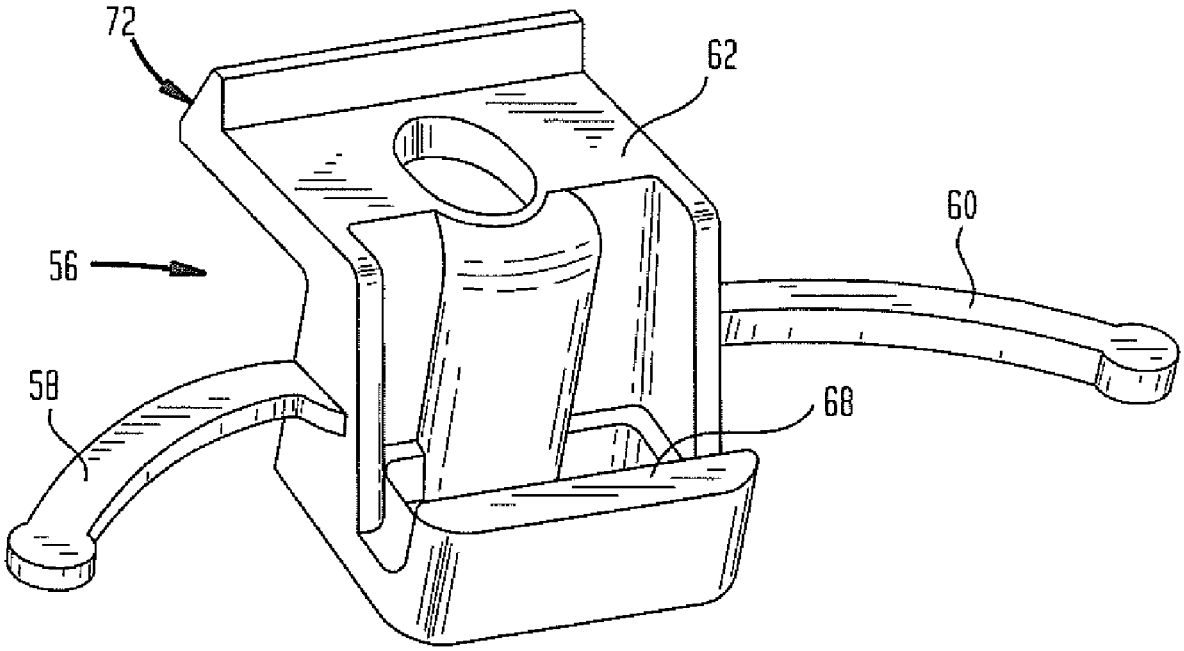
FIG. 4 is a perspective bottom view of the unitary latch shown in FIG. 3.

It is appreciated from FIG. 3 in particular that the guide ridges extend progressively further from the inner surface of faceplate 14 with increasing distance from the dispensing aperture, thereby flaring away therefrom. The guide ridges are further characterized in that they are generally orthogonal to an elongate axis 55 of the dispensing aperture. It is also appreciated from the various diagrams, that the guide ridges are generally parallel to an axis 57 of the storage chamber when the faceplate is in the closed position.

Faceplate 14 is preferably injection-molded and of unitary structure. A Preferred class of materials are acrylonitrile-butadiene-styrene (ABS) molding compositions due to their unique combination of impact resistance and warp resistance.

Faceplate 14 is also provided with a unitary injection-molded locking latch 56 which is provided with a molded-in spring in the form of a pair of arms 58, 60 which bear upon the guide ridges to bias latching member 62 of the latch to a locking position where it is maintained when mounted in the faceplate. When faceplate 14 is closed (FIG. 1) lock member 62 is thus maintained in locking engagement with portion 64 of bracket 20 when the faceplate is closed so that the faceplate cannot be opened. Moreover, the locking latch 56 is mounted at inner surface 50 of faceplate 14 adjacent an end 66 of aperture 44. Latch 56 is thus concealed from view when the dispenser is closed, but readily accessible through aperture 44 to a technician aware of its placement at the end of the dispensing aperture.

In order to release the latch, a technician simply pulls the latch away from the locking position by pulling on a lip 68 of the latch to displace it inwardly toward the center of the aperture.

Preferably, the latch has a beveled edge 72 to facilitate closing and is made of relatively durable polymer such as nylon or polyacetal. Celcon acetal copolymer is available from Celanese Limited, Dallas, Tex.

Figure 5:
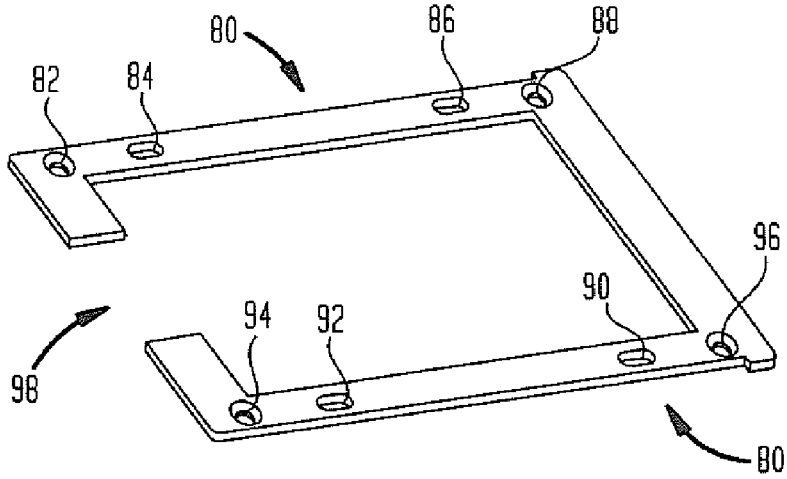
FIG. 5 is a view of a collar that can be used to mount the bracket and faceplate of FIG. 3 on an existing dispenser.

Optionally, faceplate 14 and bracket 20 are provided as part of a kit with an additional collar 80 as shown in FIG. 5. Collar 80 is sized to fit around an existing dispenser and to be secured to bracket 20 through an existing flange, for example. Holes 82, 88, 94 and 96 are provided to secure the collar to bracket 20, while holes 84, 86, 90 and 92 can be used to secure the collar to a counter in which the dispenser is mounted. A cutaway 98 in the collar can be used to accommodate features of an existing dispenser, such as a latch which is no longer used. Thus, the inventive arrangement is used to retrofit existing dispensers so that they are easier to operate.

In a preferred construction of the inventive dispenser, bracket 20 defines an opening 100 (FIGS. 3, 6) suitable for retaining a stack of napkins 102 so that the dispenser may be more easily loaded. To this end, opening 100 is adjacent a pair of lateral retention ledges 102, 104 which progressively project inwardly so that the napkins will be restrained within the dispenser when the cover (faceplate 14) is open. Preferably retention ledges 102, 104 have a profile configured to grip the napkins lightly but allow them to slip out without imposing such a force on them that they will not be torn or otherwise damaged as they are dispensed.

Figure 6:
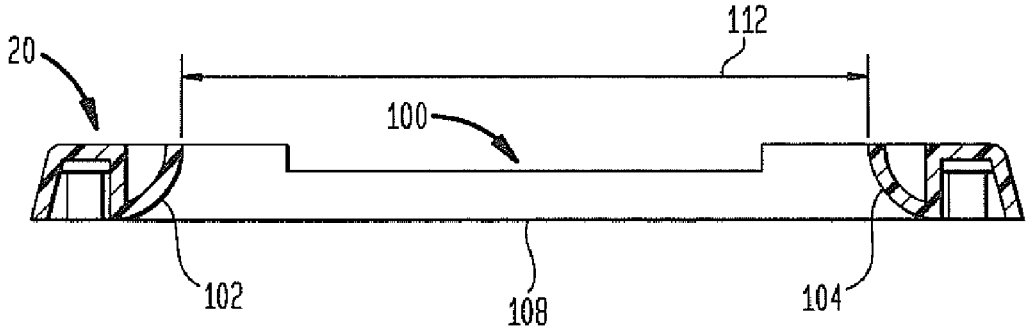
FIG. 6 is a view in section of the mounting bracket of FIG. 3 along line 6-6 showing the profile of dispensing opening 100.

In this regard, it is noted that a geometry with simply a rectangular cantilever projecting over the opening of the storage chamber was less desirable than the bowed geometry seen in FIG. 6.

Figure 7:
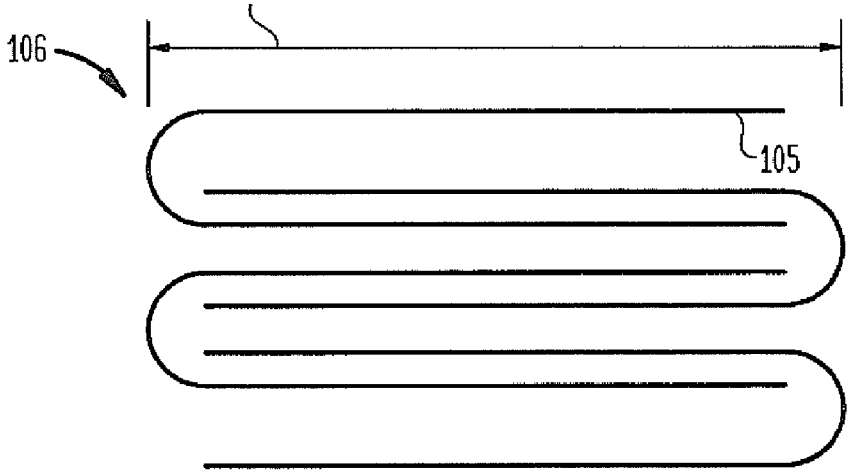
FIG. 7 is a schematic view illustrating a stack of interfolded, single fold napkins.

The relative dimensions of opening 100 and a napkin stack 106 are better understood with reference to FIGS. 6 and 7. FIG. 6 is a view in section along line 6-6 of FIG. 3 showing the profile of bracket 20. Bracket 20 has two laterally inwardly projecting retention ledges 102, 104 as shown in the Figures. Each of these retention ledges 102 and 104 has an arcuate profile which flares upwardly and inwardly from its lower portions to its upper portions located adjacent dispensing opening 100. At the lower portion, the bracket defines a lateral span 108 which is generally larger than the lateral span or width 110 of napkins to be dispensed through opening 100. At the upper part of opening 100 the span between edges 102, and 104 as shown at 112 is generally less than the span 110 of a napkin stack 106 to be dispensed there through. Thus, if it is desired to dispense a stack of interfolded, single folded napkins 106 as shown in FIG. 7 through opening 120, the progressively inwardly projecting retention ledges 102, 104 will restrain the stack as well as guide it through opening 102. As will be appreciated from the diagram, portions 102, 104 most preferably have an inwardly bowed, convex profile which projects progressively toward the center of the dispenser with height (toward the aperture) to facilitate dispensing through the opening without tearing or otherwise damaging the napkins. This geometry is also effective for hindering upward motion of the stack which is biased by spring 18. It will be further appreciated from FIGS. 6 and 7 that the tails (such as tail 105) of the napkins have their edges parallel to the contour lines of convex profiles 102, 104 in a preferred embodiment. That is to say, the edges of the tails of the napkins are generally parallel to axis 55 of aperture 44 as may be seen in FIG. 1.

In a preferred embodiment, span 110 of the napkins may be about 5 inches or so and the span at 112 may be about 4.5 inches, about 10% less than the width of the napkin stack.

FIG. 8 is a detail showing spring 18 attached to end plate 16, there is shown in FIG. 9 an enlarged view of hook 19 and stop pin 25 for purposes of illustration. It will be appreciated from the discussion above that plate 28 is most preferably identical to plate 16 and secured to spring 18 in an identical manner. To this end, posts such as 21, 23 and hooks such as 17, 19 position and secure the plates to the spring. The radial hooks 17 have a finger 17*a* extending generally in a radial direction with respect to axis 57 of spring 18 to secure the spring axially, while the tangential hooks 19 have a finger 19*a* extending generally in a tangential direction with respect to the coils of spring 18 to hinder rotation of the spring and secure it to the plates.

Plates 16, 28 are suitably injection-molded from an ABS resin composition which is used for the other components of the dispenser such as the U-shaped panels defining the storage chamber for the napkins.

Figure 10:
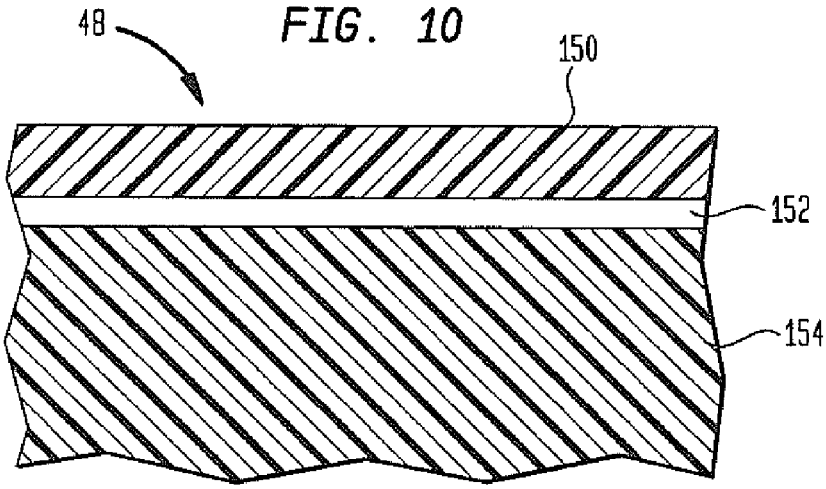
FIG. 10 is a detail showing a label film disposed on the outer surface of face plate 14 of dispenser 10.

A napkin dispenser faceplate of the invention is likewise made by injection-molding such that it has molded-in guide ridges inclined to the aperture in a unitary structure as illustrated. A preferred faceplate has a molded-in label film at its outer surface which gives the faceplate a brushed stainless steel appearance, for example, when a polymer layer printed with an appropriately pigmented ink is used. The inventive dispenser is most preferably provided with a decorative cover film 48 of the type illustrated schematically in FIG. 10. In FIG. 10 there is shown a film such as film 150 which is provided with an ink layer 152 as shown in the diagram. Film 150 may be a relatively thin, polycarbonate film if so desired, while ink layer 152 may be any suitable ink, preferably an ink which provides a metallic appearance to film 150. A preferred method of fabrication is to print ink 152 onto film 150 and then thermoform the film into the desired shape. The thermoformed film is then positioned in a mold. Thereafter a structural resin, such as resin 154, is injection-molded onto the ink layer of the film while it is disposed in the mold. Thus, the surface appearance is provided by way of a thermoformed film which has been positioned in the mold and provided with a structural backing to form the faceplate. The bilayer film preferably extends substantially over the entire outer surface of the faceplate.

Figure 11:
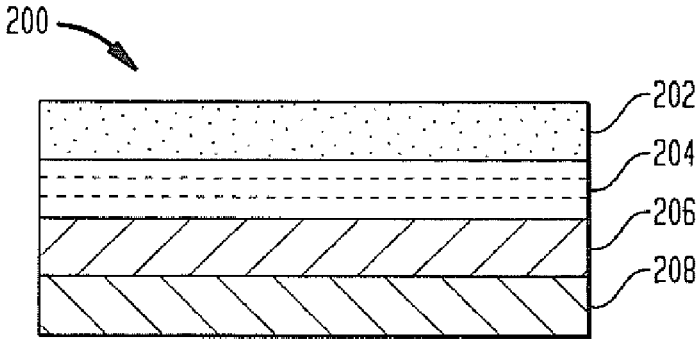
FIG. 11 is a schematic view of a multilayer mold-in label film useful in connection with the invention.

Alternatively, metallic foil containing label film is used. A label film is shown schematically in FIG. 11. Film 200 includes an optional adhesive layer 202 for securing it to the mold, optionally a protective outer layer 204 of transparent polymer, a facestock layer 206 and another optional melt-activated adhesive layer 208. Other suitable films are disclosed in U.S. Pat. No. 6,773,653 to Miller et al. The films are pre-cut and adhered to the mold by way of layer 202, then the part is injection-molded from a molten injection-molding composition applied over the film. The heat-activated adhesive layer 208 of the film melt-bonds with the pail to produce a durable structure which provides a very large number of decorative options by way of choosing a suitable facestock layer. Moreover, other layers may be added as desired. The faceplate of the invention can thus be made with a metallic appearance on one side and integral plastic guide ridges on the other side without the need for making multiple parts to achieve the desired effect.

The optional heat activated or heat-activatable layer of the label film is a layer of material which is activated by heat during the molding process to improve bonding of the label to a plastic article in the molding process. Materials for the heat-activatable adhesive layer may comprise any heat-activatable adhesive or thermoplastic film material. Such materials include but are not limited to the following film-forming materials used alone or in combination such as polyolefins, (linear or branched), metallocene catalyzed polyolefins, syndiotactic polystyrenes, syndiotactic polypropylenes, cyclic polyolefins, polyacrylates, polyethylene ethyl acrylate, polyethylene methyl acrylate, acrylonitrile butadiene styrene polymer, ethylene-vinyl alcohol copolymer, ethylene-vinyl acetate copolymers, polyamides such as nylon, polystyrenes, polyurethanes, polysulfones, polyvinylidene chlorides, polycarbonates, styrene maleic anhydride polymers, styrene acrylonitrile polymers, ionomers based on sodium or zinc salts of ethylene/methacrylic acid, cellulosics, fluoroplastics, polyacrylonitriles, and thermoplastic polyesters. More specific examples are the acrylates such as ethylene methacrylic acid, ethylene methyl acrylate, ethylene acrylic acid and ethylene ethyl acrylate. Also, included are polymers and copolymers of olefin monomers having, for example, 2 to about 12 carbon atoms, and in one embodiment 2 to about 8 carbon atoms. These include the polymers of alpha-olefins having from 2 to about 4 carbon atoms per molecule. These include polyethylene, polypropylene, poly-1-butene, etc. An example of a copolymer within the above definition is a copolymer of ethylene with 1-butene having from about 1 to about 10 weight percent of the 1-butene comonomer incorporated into the copolymer molecule. The polyolefins include amorphous polyolefins. The polyethylenes that are useful in the heat seal layer include those with various densities including low, medium and high density ranges. The ethylene/methyl acrylate copolymers available from Chevron under the tradename EMAC can be used. These include EMAC 2260, which has a methyl acrylate content of 24% by weight and a melt index of 2.0 grams/10 minutes at 190° C., 2.16 Kg; and EMAC SP 2268T, which also has a methyl acrylate content of 24% by weight and a melt index of 10 grams/10 minutes at 190° C., 2.16 Kg. Polymer film materials prepared from blends of copolymers or blends of copolymers with homopolymers are also useful.

Also, the heat activatable first adhesive layer may contain antiblock additives (such as silica, diatomaceous earth, synthetic silica, glass spheres, ceramic partides, etc.) This layer also may contain an antistatic additive (such as an amine or an amide or a derivative of a fatty acid).

The heat activatable adhesive layer is designed for and activated at temperatures known to those skilled in the art. Generally the heat-activatable first adhesive layer has a lower melting point than any of the other layers of the in-mold label. While the heat activatable layer may activate at temperatures below those specified for activation, the layer is designed to activate at certain temperatures based on the substrate material under normal in-mold labeling conditions. In one embodiment, the heat activatable adhesive layer activates at temperatures between about 80° C. to about 300° C., more often the heat seal layer activates at temperatures between about 87° C. to about 250° C.

The facestock layer may include or consist of paper, foils, pigmented polymer layers and so forth as enumerated in U.S. Pat. No. 6,773,653 noted above.

The polymer facestock and the heat activatable first adhesive layer may be formed by simultaneous extrusion from two or more extruders with a suitable coextrusion die whereby the facestock and first adhesive layer are adhered to each other in a permanently combined state to provide a unitary coextrudate. A tie layer (adhesion promoting layer) may also be coextruded with the facestock and the heat-activatable first adhesive layer to improve the adhesion of the heat-activatable layer to the facestock. Alternatively, a coating process may be used to lay down a layer of the heat-activatable material on the facestock, or the two layers can be formed separately and thereafter laminated together with or without the acid of an adhesive layer.

While the invention has been illustrated in connection with several examples, modifications to these examples within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary.

What is claimed is:

1. A kit with a locking faceplate for mounting on a napkin dispenser housing comprising:

(a) a mounting bracket;

(b) means for securing the mounting bracket to the dispenser housing;

(c) a faceplate with an elongate aperture;

(d) hinge means for pivotally mounting the faceplate to the mounting bracket such that it is movable between a closed position for dispensing a stack of napkins and an open position for reloading; and (e) means for locking the faceplate in the closed position, the locking means being slideably operable relative to the faceplate to lock the faceplate to the mounting bracket in the closed position and including release means for unlocking the faceplate located adjacent an inner surface of the faceplate such that when the faceplate is in the closed position on a dispenser the release means is concealed in the interior of the dispenser and accessible through the dispensing aperture.

2. The kit according to claim 1, wherein the means for securing the mounting bracket to the dispenser includes a mounting collar adapted to be secured to the mounting bracket.

3. The kit according to claim 1, wherein the locking means includes biasing means adapted to maintain it in a locked position.

4. The kit according to claim 3, wherein the locking means includes an injection-molded unitary latch including an integrally-formed spring and a latch member.

5. The kit according to claim 4, wherein the injection-molded unitary latch member is formed from an injection-molding composition comprising nylon, polyacetal or polyester.

* * * * *